US008721214B2

(12) United States Patent
Novotny

(10) Patent No.: US 8,721,214 B2
(45) Date of Patent: May 13, 2014

(54) CULVERT WITH A DEFORMATION ZONE

(76) Inventor: Petr Novotny, Pardubice (CZ)

( * ) Notice: Subject to any disclaimer, the term of this patent is extended or adjusted under 35 U.S.C. 154(b) by 0 days.

(21) Appl. No.: 13/807,600

(22) PCT Filed: Dec. 30, 2010

(86) PCT No.: PCT/CZ2010/000135

§ 371 (c)(1),
(2), (4) Date: Dec. 28, 2012

(87) PCT Pub. No.: WO2012/000460

PCT Pub. Date: Jan. 5, 2012

(65) Prior Publication Data

US 2013/0101346 A1 Apr. 25, 2013

(30) Foreign Application Priority Data

Jun. 30, 2010 (CZ) ..... 2010-524

(51) Int. Cl.
*E01F 15/00* (2006.01)

(52) U.S. Cl.
USPC ..... 404/2; 405/124

(58) Field of Classification Search
USPC ..... 405/124, 125, 126; 14/13, 24, 74.5; 404/2; 138/105, 106
See application file for complete search history.

(56) References Cited

U.S. PATENT DOCUMENTS

| | | | | | |
|---|---|---|---|---|---|
| 948,500 | A | * | 2/1910 | Davis | 138/100 |
| 985,539 | A | * | 2/1911 | Ottney | 138/162 |
| 1,197,966 | A | * | 9/1916 | Sweney | 138/100 |
| 1,412,616 | A | * | 4/1922 | Kammerer et al. | 138/102 |
| 1,784,271 | A | * | 12/1930 | Collins | 405/124 |
| 4,314,775 | A | | 2/1982 | Johnson | |
| 4,695,187 | A | * | 9/1987 | Mikhailovsky et al. | 405/124 |
| 4,735,234 | A | * | 4/1988 | Matiere | 138/105 |
| 5,040,921 | A | * | 8/1991 | Torok | 405/150.1 |
| 6,698,977 | B1 | | 3/2004 | Charon | |

FOREIGN PATENT DOCUMENTS

CZ 19993 U1 9/2009

OTHER PUBLICATIONS

International Search Report mailed Feb. 8, 2011; PCT/CZ2010/000135.

* cited by examiner

*Primary Examiner* — Gary Hartmann
(74) *Attorney, Agent, or Firm* — Ladas & Parry LLP

(57) ABSTRACT

The culvert with the deformation zone consists of prefabricated components arranged in the road ditch (1). The culvert includes at least one fixed basic component and at least one deformation component sliding in the basic component in the direction of the longitudinal ditch axis (1) and covered by a deformable decking or also by backfilling or other cover. The substance of the invention lies in the fact the basic component consists of a set of prefabricated concrete or reinforced concrete beds (2) formed in "V"-shape and placed one after another on the concrete base (3) in the road ditch (1) so that the shoulders (2*a*, 2*b*) of the beds (2) abut the ditch walls (1). Both shoulders (2*a*, 2*b*) of each bed (2) are fitted with opposite guiding recess (4) in the upper part for placement of deformation components formed by a set of at least two lateral rigid girders (5) installed with the possibility of the sliding movement in the direction of the longitudinal ditch axis (1). There are deformation gaps (6) between each lateral girder (5) and at least one front of the culvert contains at least one further deformation component in the recesses (4) with possibility of sliding movement that forms the front component (7) fitted with soft layer (14) from soft and resilient deformable material on at least its front part.

13 Claims, 4 Drawing Sheets

CULVERT WITH A DEFORMATION ZONE

BACKGROUND AND SUMMARY OF THE INVENTION

This invention relates to civil engineering, in particular to a culvert built as a crossing or driveway especially in the road ditches that drain water from roads. The subject of the invention is a culvert of increased safety fitted with deformation zone that limits the risk of fatal consequences of accidents when a car goes off the road and hits the culvert.

In most cases, the culverts are constructed as solid structures with vertical fronts. A tube for conducting water through the culvert is installed in a concrete bed and concreted and backfilled between solid, usually concrete or bricked, fronts. The main disadvantage of this solution, particularly with respect to safety, is the vertical front of the culvert because consequences of frontal crash of a car slipping from the road hitting the vertical culvert front are usually serious and result in fatal car accidents. The other disadvantage is the wet process of construction of the fronts lengthening the construction time and does not allow construction works at low temperatures.

The culvert with inclined front is another option of the solution. It eliminates the danger of frontal crash for a car going off the road. On the other hand it happens that the car rides on the culvert at high speed and is catapulted back to the road with identically serious, if not much more serious, consequences than the frontal crash with the vertical culvert front. In addition, construction of the inclined front is technologically much more demanding and appropriate cutting of the tube is required and therefore, construction of the culvert is more expensive and time demanding compared to the vertical front culvert, including the disadvantage of the wet process.

The utility design CZ 19993 describes a solution that should minimize fatal consequences of the frontal crash of a car in the culvert front. The design of the culvert contains a deformation zone consisting of the "U" shaped piece filled with two opposite concrete deformation fronts with stiff, non-deformable bumpers and opposite blocs. Front pieces, sliding in the basic shaped piece, are adjacent to both fronts. The basic shaped piece with the front covers a decking consisting of sliding telescopic segments. The decking is covered with gravel for vehicles to pass. Upon impact, the front pieces retract and activate the protective functions of the deformation front and the bloc. After accident, the front piece is removed and the damaged deformation fronts with the blocs are either extracted or removed after removal of the backfill and the decking. Serious consequences of the frontal impact are thus really minimized but on the other hand, construction, building and maintenance of the culvert is demanding. The basic "U" shaped piece does not follow the ditch shape, which is usually in "V" shape and ground works must always be performed to install the shaped piece in the ditch. The solution is extensive and heavy, which increases both production as well as transport costs related to prefabricated components.

The utility model CZ 19993 describes also an option of the culvert applicable as crossing for bike riders or pedestrians over the road ditch. This option of the culvert is constructed without the base shaped piece. It only consists of deformation fronts with the deformation bloc that may be installed between them. The fronts are covered by a decking with backfill. This solution is not suitable for driveways of cars because of limited loading capacity.

The task of the invention is to create a culvert with improved safety diminishing the danger for cars going off the road, the construction costs of which would be low, not time demanding; the culvert requiring minimum maintenance and in case of damage it would require minimal reparations.

The above specified goal is achieved by creation of a culvert according to this invention. The culvert with the deformation zone consists of prefabricated components installed in the road ditch with at least one fixed basic component and one deformation sliding component in the basic component in the direction of longitudinal ditch axis. The culvert assembly is covered by a deformable decking or backfill or otherwise.

The substance of the culvert according to this invention lies in the fact that the basic component consists of a set of prefabricated concrete or reinforced concrete beds of a "V" shape placed one after another in the concrete foundation in the road ditch so that the bed shoulders abut the ditch walls. Both shoulders of each bed are fitted with opposite guiding recess for installation of the deformation components consisting of an assembly of at least two lateral stiff girders installed with the possibility of a sliding movement in the direction of the longitudinal ditch axis. There are deformation gaps between the lateral rigid girders and at least one culvert front recess with possibility of the sliding movement of at least one further deformation component that forms the front component provided with soft layer made of deformable and tough material at least on its front side.

The advantage of this design of the culvert is that it does not contain any large basic "U" shaped piece that would increase the construction costs and the "V" shaped beds follow the ditch shape and therefore, the ground works are limited to a necessary minimum consisting of landscaping to install the concrete foundation and the beds. The deformation zone directly consists of lateral stiff girders included in the decking and their sliding is easily ensured by dry placement in the beds, allowing them to slide in the deformation gaps, which allows for deformability of the culvert in the longitudinal direction together with the front component or components. The front component made of soft and tough deformable material absorbs a part of kinetic energy of a car during impact by means of its own deformation and therefore, at lower speeds, the lateral rigid girders may not slide at all. The front component also ensures even sliding of the lateral rigid girders at impacts of higher kinetic energy. Warning road safety equipment of deformable design can be installed on the front component, e.g. direction columns or road fences. In case of higher impact speeds, e.g. in rural zones, the culvert can be fitted with any number of deformable front components arranged in a row.

In an advantageous embodiment of the invention the bed of the culvert forms two independent shoulders placed on a foot fitted with retaining slants and connected with the bottom. In this embodiment, the prefabricated components prepared to be assembled are light and storable and therefore, they are suitable for manual handling during transport and assembly.

In another advantageous embodiment of the culvert the guiding recesses in the bed shoulders of the culvert are created as "L" shaped open semi-grooves and the lateral rigid girders are on both ends adjusted in the shape of flat profile fitting in the guiding recess.

The lateral rigid girders may be made of concrete, reinforced concrete, wood or a composite plastic material. The beds are made of concrete or reinforced concrete. To secure the sliding movement of the girders in the recesses of the bed shoulders, their plain dry fitting is sufficient or a sliding Teflon layer may be installed here.

In another advantageous embodiment of the culvert the lower part of the lateral rigid girders are provided with the guiding and supporting brackets fitted on the bed shoulders.

The shape of the girders is designed so that the girders show sufficient vertical rigidity and strength at low weight and the girders do not collapse inside the bed or lift above the upper edge of the culver in case of crash. To this the advantageous embodiment of the girder corresponds where the upper girder part consists of two flat shoulders and the guiding and supporting brackets are directed in the normal line direction to the bed shoulder surfaces.

In another advantageous embodiment of the culvert the deformable decking designed so that the deformation gaps between individual lateral rigid girders are covered by flexible strips that form the decking of the culvert with the upper sides of the girders.

The flexible strips must be of sufficient loading capacity so that they can be backfilled or covered. They also must be easily deformable to ensure good deformability of the culvert in longitudinal direction together with the sliding movement of the girders and the function of the front components. The advantage of the flexible strips consists in their easy replacement during reparation of the deformed culvert which will be damaged only partially in most cases. The benefits of the rubber strips consist in improved draining of the road on the driveway point.

The flexible strips are advantageously made of rubber and fitted with reinforcing and distance ribs on their lower side to fit in the deformation gaps.

During assembly, the ribbed rubber strips will also provide technological spacing of the lateral rigid girders for creation of the deformation gaps. On the culvert decking, there is backfilling, preferably from light aggregate for easy movement of the girders in longitudinal direction. The backfilling may be made of e.g. soil, gravel or as a cover of bitumen road or otherwise. Depending on growing load of the decking and deteriorated conditions for shifting of the girders, the culvert may be fitted with higher number of deformable front components.

In another advantageous embodiment of the culvert the inner components of the bed bottom are rounded, arranged at the same level as the ditch bottom and the assembly of beds in the road ditch exceeds the assembly of lateral rigid girders and front components in the direction of longitudinal axis of the road ditch at least on one side of the culvert. In this embodiment, the culver fully follows the shape and profile of the road ditch and in case of the beds exceeding the assembly on both sides, the culvert can slide in both directions in the longitudinal axis of the ditch in case of impact.

It is furthermore advantageous that the front component in the vertical direction exceeds in height the upper edges of the bed shoulders over the upper edges of the lateral rigid girders or over the upper edges of the strips. In this embodiment, the front component sweeps the flexible strips during the impact to avoid their contact with a car crashed and forms a border for application of the backfilling or bitumen or other road surface of the driveway.

It is furthermore advantageous when the front component forms a sandwich panel with alternate soft polyurethane layers, air layers and fixed layers made of solid plastic ribs for spatial rigidity in two directions, whereas the road-fence and/or warning column is preferably anchored to the front component.

It is finally advantageous when draining holes are made on the bed shoulders for draining water from side walls of the ditch in the culvert.

The advantages of the culvert according to the invention consist in that the double deformation zone significantly reduces the overload value applicable on the car crew at the moment of impact and in consequence of which traumatic injuries occur. Thanks to simple composition of the prefabricated components, the culvert is characteristic by a short construction time, for a standard culvert the construction time is about 2 days. Another benefit is an easy maintenance because the culvert has higher bore diameter compared to classic construction procedure; if the culvert is highly contaminated (e.g. by sludge), the culvert can be disassembled easily and reassembled after cleaning and when the culvert is damaged by an impact, only damaged part need be replaced.

Furthermore, the culvert is characteristic by high durability due to improved quality of prefabricated components and lower price due to series production of the prefabricated components as well as easy construction without use of heavy machinery.

Finally, better draining is advantageous because the culvert does not interrupt draining of the ground plane and improves better road draining along the culver in case of rubber road surface.

BRIEF DESCRIPTION OF THE DRAWINGS

The invention will be explained in detail by means of the drawings on which

Detailed description of the preferred embodiments

The below described and depicted particular examples of the invention embodiments are considered illustrative and they in no way limit the invention embodiment to the examples herein presented. Professionals in the technology sphere will find or will be able to find more or fewer equivalents to the specific embodiments of the invention herein described in their routine experimental work. These equivalents will also be included in the following claims.

Figure 5:
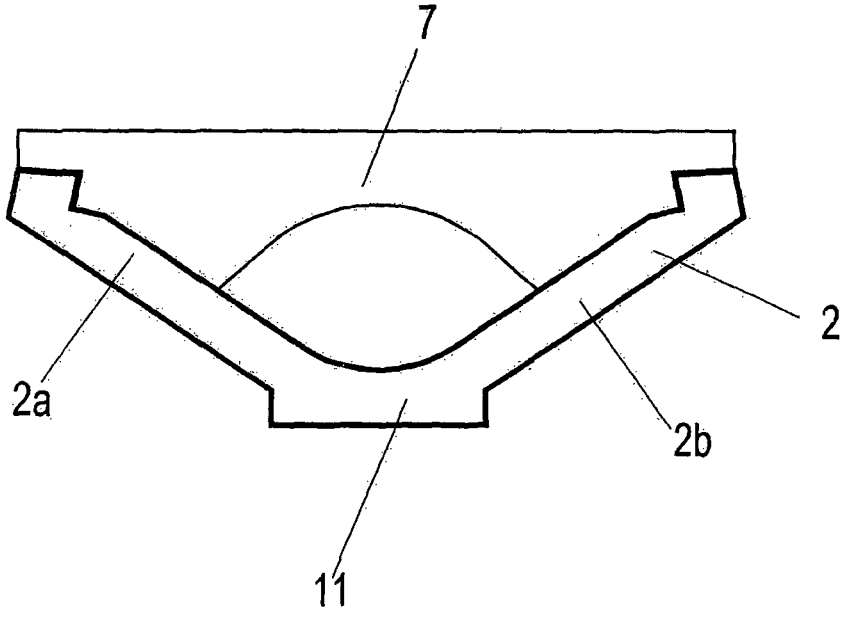
FIG. 5 shows the bed forming one unit with the foot and fitted with the front component.

The specific culvert design is always derived from the required utility length of the culvert, span of the bridged road ditch 1, transport load of the culvert, speed, intensity and composition of the traffic flow on adjacent road. For the culvert according to the design example, FIG. 1, FIG. 2, FIG. 3, the road ditch 1 bottom has a plain concrete foundation 3 made of plain concrete. The foundation 3 can be directly fitted with the integrated prefabricated beds 2 in the "V" shape as shown on FIG. 1 and FIG. 5 or the beds 2 can be produced as divided and set up of individual prefabricated components of the shoulders 2*a*, 2*b* of the bottom 12 and the foot 11, as shown on FIG. 2.

The prefabricated components are made of concrete or reinforced concrete. In the upper sections of the shoulders 2*a*, 2*b* there are guiding recesses 4 in opposite directions forming "L"-shaped semi-grooves, in the lower sections of the shoulders 2*a*, 2*b* there are relevant recesses for anchoring of the bottom 12 and installation on the foot 11. Shoulders 2*a*, 2*b* of the beds 2 are fitted with draining holes 18 for water draining in the culvert. The draining holes 18 are created in some shoulders 2*a*, 2*b* only, arranged in opposite alternation and guided horizontally towards the side walls of the ditch 1. The shoulders 2*a*, 2*b* are furthermore fitted with the assembly and connection holes 17.

Following installation of the beds in the road ditch 1, the lateral rigid girders 5 are placed in the guiding recesses 4, which are made as prefabricated components from concrete or reinforced concrete. Alternatively, the lateral rigid girders may be made of wood or composite plastic materials. The girders 5 are arranged in rectangle profile at their ends that fits in the guiding recesses 4. There are deformation gaps 6 between the adjacent girders 5 that allow deformation of the culver in direction of the longitudinal axis of the road ditch 1 in case of frontal crash by movement of the girders 5 on the guiding recesses 4 of the beds 2 to the deformation gaps 6.

The girders 5 are fitted with the relief holes 19 for lower weight and their shape is selected so that they are not destructed either upwards or downwards in case of the crash.

For this purpose, there are guiding and supporting brackets 8 in the lower section of the girders 5 directed in the normal line direction to the shoulder surfaces 2*a*, 2*b*. The brackets 8 improve static and dynamic properties of the girders 5 and of the culver as a whole and they contribute to the girders 5 acting as compact bodies during impact and move in parallel planes.

The decking over the girders 5 consists of two flexible rubber strips 9 made as independent segments that fit in each other using the teeth 20 and they cover the deformation gaps 6 between the girders 5. In another embodiment the flexible strips 9 could consist of continuous, parallel strips without the teeth 20. In the lower section of each flexible strip 9, there is a reinforcing and distance rib 10 that fits between the adjacent girders 5 in the deformation gap 6. Individual segments of the flexible strips 9 are installed together with the girders 5 and the reinforcing and distance ribs 10 are also used for definition of exact width of the deformation gaps 6 between the girders 5 during assembly. The teeth 20 are shaped so that the segment of the flexible strip 9 is lifted up upon impact over the adjacent segment and the segments are shifting on each other in the direction of longitudinal axis of the road ditch 1 together with the girders 5. Another covering layer may be put on the decking, including the bitumen one, but the decking is preferably covered by backfill 22 from light aggregate allowing the cars, bike riders and pedestrians to cross and does not prevent the longitudinal deformation of the culvert.

On the culvert fronts there are other deformation components—front components 7 in the recesses 4 of the beds 2. First, their soft front part prevents injury and second, they can absorb a part of the kinetic energy upon the impact by internal deformation and third, they act as an action member for equal and successive deformation of the culvert in the direction of the longitudinal axis of the road ditch 1.

Figure 1:
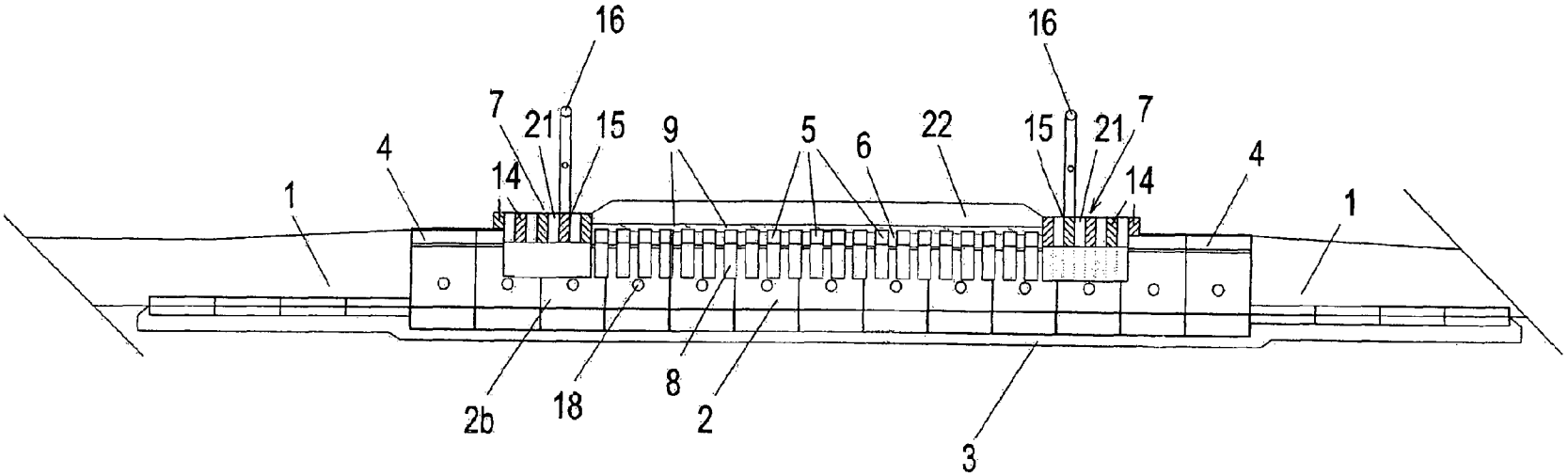
FIG. 1 shows longitudinal section of the culvert in a road ditch with the one-piece bed.
Figure 2:
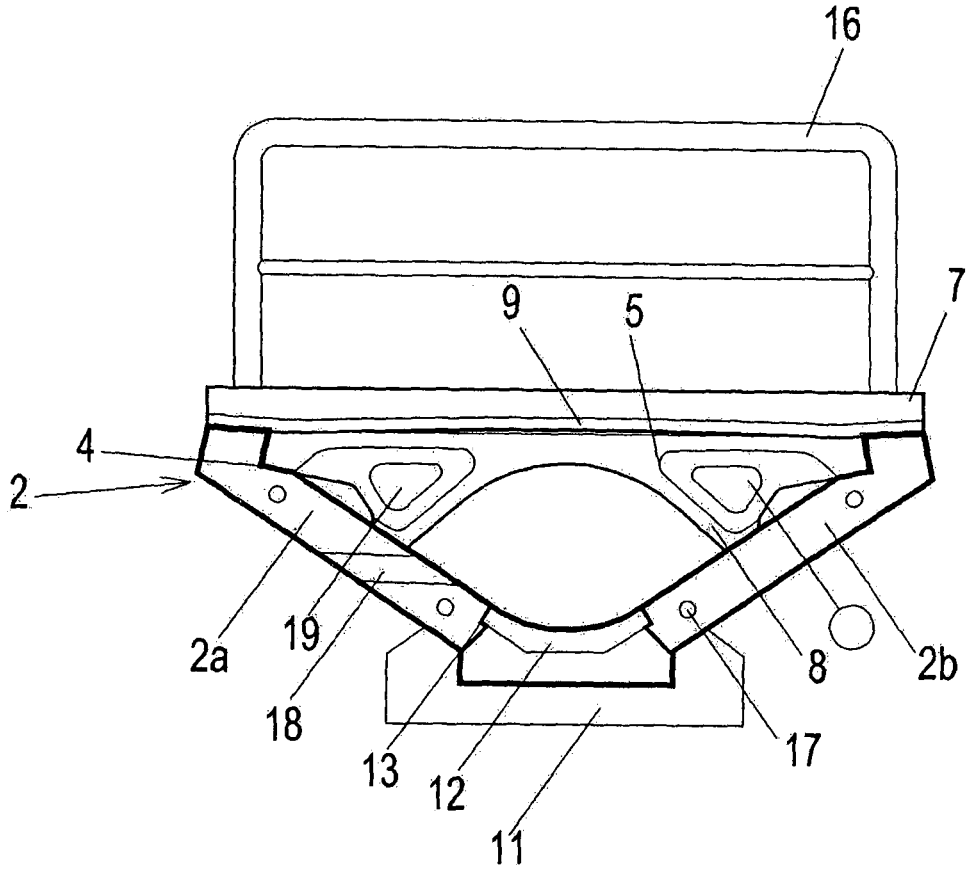
FIG. 2 shows cross section with the road fence and divided bed.
Figure 3:
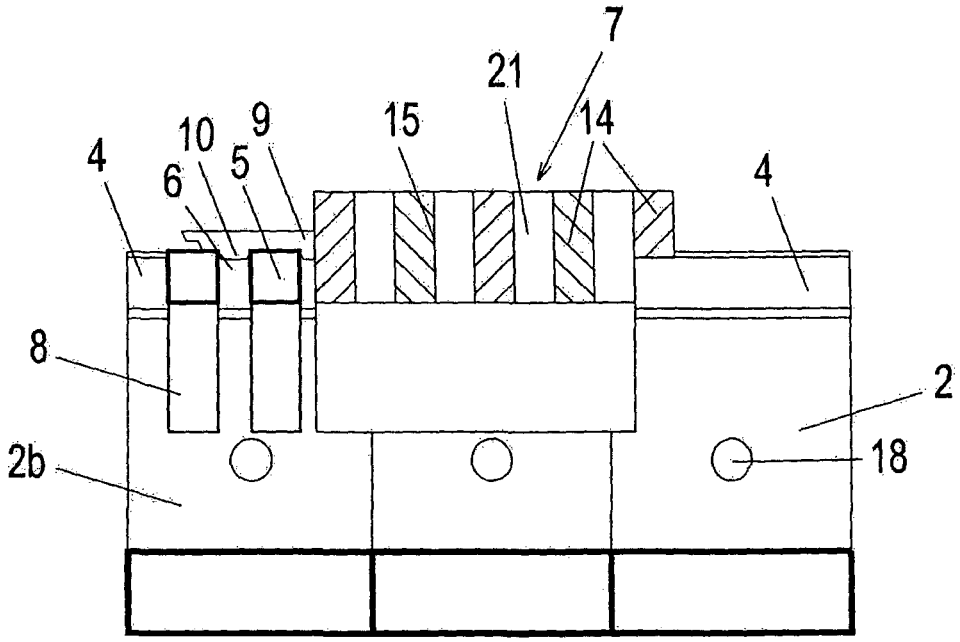
FIG. 3 shows detailed longitudinal section of the culvert in the area of the front component without road fence.
Figure 4:
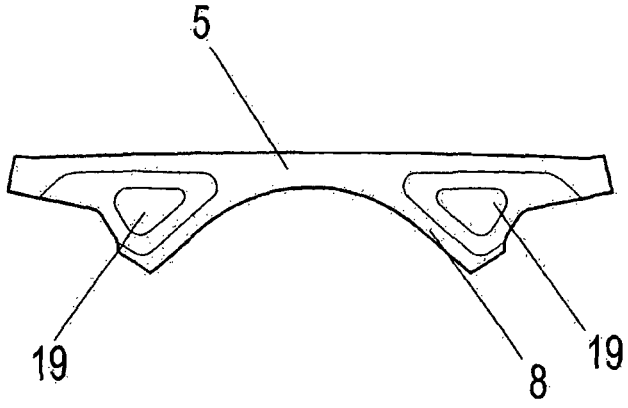
FIG. 4 is a view of the lateral rigid girder.

The front components 7 may be created as simple solid lintels with front soft layer 14 or they can be produced as deformable sandwich panels where soft layers 14 based on polyurethane and the air gaps 21 with solid layers 15 consisting of plastic ribs are alternated, as seen in FIG. 1 and FIG. 3. The front component 7 consists of welded structure made from plastic materials where inserts made from polyurethane foam are made and the front part has the soft layer 14 glued on it.

The front component 7 in the vertical direction exceeds in height the upper edges of the bed shoulders 2*a*, 2*b*, of the beds 2 and of the lateral rigid girders 5 or flexible strips 9 and forms a border for application of the backfilling or bitumen or other road surface. Deformable road fences 16 are fitted to the front components 7.

As seen on FIG. 1, the inner parts of the bottom 12 of the beds 2 are rounded and arranged at the same level as the ditch 1 bottom. The set of beds 2 in the road ditch 1 on both sides of the culvert exceeds the set of lateral rigid girders 5 and the front components 7 in the direction of longitudinal axis of the road ditch. The other deformation effect of the culvert of this design is achieved by the fact that the culvert may move in the road ditch 1 forward or rearwards in case of the strong impact, which is suitable particularly because of preventing total destruction of the culvert and the only the damaged part need be repaired. The sliding movement rearwards is suitable in case of a car moving in opposite direction.

The culvert with the deformation zone according to the invention can be used for traffic and construction solution of the driveways on the adjacent road and lands across the road ditches, especially in the areas where there is a need for increased safety and protection of cars and of the car crew in case of frontal crash in the culvert. The deformable components can preferably be used for reconstruction of the existing fixed fronts of the culverts for several times.

SUMMARY OF REFERENCE MARKS USED IN THE DRAWINGS

1 road ditch
2 bed
2 *a* bed shoulder
2 *b* bed shoulder
3 concrete foundation
4 guiding recess
5 lateral rigid girder
6 deformation gap
7 front component
8 guiding and supporting bracket
9 flexible strip
10 reinforcing and distance rib
11 foot
12 bed bottom
13 slant
14 soft layer
15 fixed layer
16 fence road
17 connection hole
18 draining hole
19 relief hole
20 teeth
21 air gap
22 backfill

The invention claimed is:

1. A culvert with a deformation zone consisting of prefabricated components arranged in a road ditch the culvert comprising at least one fixed basic component and at least one deformation component sliding in the basic component in the direction of the longitudinal culvert axis and covered by a deformable decking or backfilling or by a cover, wherein the basic component of the culvert is formed by a set of prefabricated concrete or reinforced concrete beds of a "V"-shape comprising two shoulders, the beds being placed adjacent to each other on a concrete foundation in the road ditch so that the shoulders of the beds abut to the ditch walls, and the upper part of both shoulders of each bed is fitted with opposing guiding recesses for arrangement of deformation components formed by a set of at least two lateral rigid girders arranged slidingly in the guiding recesses, wherein the girders are slidable in the direction of the longitudinal ditch axis, wherein there are deformation gaps between the lateral girders and, at least on one front of the culvert at least one additional deformation component is slidingly arranged in the guiding recesses, the additional deformation component forming a front component of the culvert and fitted with a soft layer made from a soft and resilient deformable material on at least the front part of the additional deformation component.

2. The culvert according to claim 1, wherein the bed consists of independent shoulders placed on a foot fitted with supporting slants and connected with the bottom.

3. The culvert according to claim 1, wherein the guiding recesses in the shoulders of the beds are created as open "L"-shaped semi-grooves and the lateral rigid girders are shaped in flat profile both ends thereof fitting in the guiding recess.

4. The culvert according to claim 1, wherein the lower part of the lateral rigid girders is fitted with guiding and supporting brackets placed on the shoulders of the beds.

5. The culvert according to claim 4, wherein the guiding and supporting brackets are perpendicular to the surfaces of the shoulders.

6. The culvert according to claim 1, wherein the deformation gaps between the individual lateral rigid girders are covered with flexible strips that form the decking of the culvert together with the upper sides of the girders.

7. The culvert according to claim 6, wherein the flexible strips are formed by independent rubber segments fitted with reinforcing and distance ribs on their lower side fitting in the deformation gaps.

8. The culvert according to claim 6 the decking is covered by a backfill consisting of light aggregate.

9. The culvert according to claim 1, wherein the internal parts of the bottom of the beds are rounded and arranged at the same level as the ditch bottom and the set of beds arranged in the road ditch exceeds in the direction of the longitudinal ditch axis on at least one side of the culvert the set of lateral rigid girders and front components.

10. The culvert according to claim 1, wherein the front component vertically extends beyond the upper edges of the bed shoulders, lateral rigid girders, and flexible strips.

11. The culvert according to claim 1, wherein the front component consists of a sandwich panel consisting of at least one soft layer based on polyurethane, of at least one air gap and of at least one fixed layer from plastic materials.

12. The culvert according to claim 11, wherein a road fence and/or warning direction column are/is attached to the front component.

13. The culvert according to claim 1, wherein at least one of the shoulders of at least one bed is fitted with one draining hole.

* * * * *